US008139798B2

(12) United States Patent
Kotegawa et al.

(10) Patent No.: US 8,139,798 B2
(45) Date of Patent: Mar. 20, 2012

(54) SOUND REPRODUCING APPARATUS

(75) Inventors: Kazuhisa Kotegawa, Osaka (JP); Fumiyasu Konno, Osaka (JP); Shinnosuke Nagasawa, Osaka (JP)

(73) Assignee: Panasonic Corporation, Osaka (JP)

( * ) Notice: Subject to any disclaimer, the term of this patent is extended or adjusted under 35 U.S.C. 154(b) by 1452 days.

(21) Appl. No.: 11/668,108

(22) Filed: Jan. 29, 2007

(65) Prior Publication Data

US 2007/0189552 A1 Aug. 16, 2007

(30) Foreign Application Priority Data

Feb. 2, 2006 (JP) ..... 2006-025451

(51) Int. Cl.
*H04R 5/02* (2006.01)

(52) U.S. Cl. ..... 381/302; 381/27; 381/303

(58) Field of Classification Search ..... 381/86, 381/89, 97, 302, 27, 98, 307, 303, 118
See application file for complete search history.

(56) References Cited

U.S. PATENT DOCUMENTS

| | | | | |
|---|---|---|---|---|
| 3,725,586 | A * | 4/1973 | Iida | 381/18 |
| 3,885,101 | A * | 5/1975 | Ito et al. | 381/18 |
| 4,817,162 | A * | 3/1989 | Kihara | 381/97 |
| 4,972,489 | A * | 11/1990 | Oki et al. | 381/97 |
| 5,412,733 | A * | 5/1995 | Nagayoshi et al. | 381/74 |
| 6,038,325 | A | 3/2000 | Yoshida et al. | |
| 2003/0031332 | A1 * | 2/2003 | Tatsuta et al. | 381/302 |

FOREIGN PATENT DOCUMENTS

| | | | |
|---|---|---|---|
| JP | 06-022397 | A | 1/1994 |
| JP | 10-224887 | A | 8/1998 |
| JP | 10-336787 | A | 12/1998 |
| JP | 11-252680 | A | 9/1999 |
| JP | 2002-010399 | A | 1/2002 |
| JP | 2003-047097 | | 2/2003 |
| JP | 2003-047097 | A | 2/2003 |
| JP | 2003047097 | A * | 2/2003 |

OTHER PUBLICATIONS

Japanese Office Action for Application No. 2006-025451, Feb. 15, 2011, Panasonic Corporation, p. 3, Nos. 1-6.

* cited by examiner

*Primary Examiner* — Xu Mei
*Assistant Examiner* — Leshui Zhang
(74) *Attorney, Agent, or Firm* — RatnerPrestia

(57) ABSTRACT

A sound reproducing apparatus is provided with a circuit comprising a first secondary phase shifter in a front stage of at least one of channels among a first power amplifier, a second power amplifier and a third power amplifier, and a second secondary phase shifter and an adder in at least one of remaining channels for providing an output by adding output signals of a music signal source and the second secondary phase shifter. The apparatus of this structure eliminates phase interferences between a center speaker and right and left speakers by controlling sound waves generated by the center speaker, thereby achieving excellent reproduction of music.

6 Claims, 9 Drawing Sheets

SOUND REPRODUCING APPARATUS

BACKGROUND OF THE INVENTION

1. Field of the Invention

The present invention relates to a sound reproducing apparatus capable of reproducing sound of excellent quality inside of a motor vehicle, for instance.

2. Background Art

FIG. 10 is a system diagram illustrating a conventional sound reproducing apparatus. In FIG. 10, phase shifters 102 and 105, first power amplifier 103 and second power amplifier 106 are connected individually with music signal source 101. An output of first power amplifier 103 is connected to speaker 104 mounted to a left door of motor vehicle 112, and an output of second power amplifier 106 is connected to speaker 107 mounted to a right door of vehicle 112, so as to enable reproduction of music inside the vehicle. In this instance, phase shifters 102 and 105 operate in a manner to suppress standing waves generated by the right and the left walls in the vehicle to reduce an influence of the standing waves, which impedes an auditory image localization in a given position, thereby enabling a listener to enjoy excellent reproduction of music in the given position inside the vehicle.

Japanese Patent Unexamined Publication, No. 2003-47097 is one of the known examples of the prior art documents relating to the invention of this patent application.

It is possible to reduce the influence of standing waves generated by the right and the left walls in the vehicle, and to reproduce music well by using the conventional system described above.

FIG. 11 is a system diagram for use in detailing a drawback of the conventional art. In a speaker layout shown in FIG. 11, in which center speaker 111 is disposed at the front center of the vehicle interior in addition to right and left speakers 104 and 107, there occurs a phase interference between center speaker 111 and right and left speakers 104 and 107, which impairs good music reproduction.

Referring to FIG. 11, description is provided of the fact that the phase interference between right and left speakers 104 and 107 and center speaker 111 cannot be reduced even if an existing technique of phase control is used. In FIG. 11, symbol d1 indicates a distance between left speaker 104 and listening point P1, and symbol d2 indicates a distance between center speaker 111 and listening point P1. Symbol d3 indicates a distance between center speaker 111 and listening point P2, and symbol d4 indicates a distance between right speaker 107 and listening point P2. It is assumed here in order to simplify the explanation that these distances have a relation of $d1 \approx d2 \approx d3 \approx d4$. In many cases, the above relational formula applies to speaker layouts of the ordinary motor vehicles. In addition, a center frequency of phase reversion of phase shifter 102 is denoted as x, and a center frequency of phase reversion of another phase shifter 105 is denoted as y.

Under the conditions stated above, however, a phase interference occurs at listening point P1 since an output of left speaker 104 is in an opposite phase with respect to an output of center speaker 111 due to the reversion of phase by phase shifter 102 at a frequency corresponding to the center frequency x of phase reversion. Even if another phase shifter 108 of the center frequency x of phase reversion is added to a circuit of center speaker 111 by using the existing phase control technique, the phase interfere still occurs at listening point P2, since the output of center speaker 111 becomes opposite in phase to that of right speaker 107.

SUMMARY OF THE INVENTION

The present invention is aimed at overcoming the above drawback, and providing a sound reproducing apparatus of excellent sound quality.

The sound reproducing apparatus of the present invention comprises a music signal source, at least three channels of power amplifiers for amplifying an output of the music signal source, and at least three speakers for reproducing music by outputs of the power amplifiers, wherein at least one channel of the power amplifiers has a front stage comprising at least one secondary phase shifter, and at least one of the remaining channels has another secondary phase shifter and an adder for providing an output by adding output signals of the music signal source and the another phase shifter.

The above structure is capable of controlling signals of the channels that cause phase interference in a manner to attenuate only in a frequency band where the phase interference occurs, thereby providing quite excellent reproduced music sound. The sound reproducing apparatus of the present invention can improve sound characteristic at a listening position by eliminating the phase interference between right and left speakers and a center speaker inside of, for instance, a motor vehicle.

DETAILED DESCRIPTION OF THE INVENTION

Description is provided hereinafter of a best mode of embodying the present invention with reference to the accompanying drawings.

First Embodiment

Figure 1:
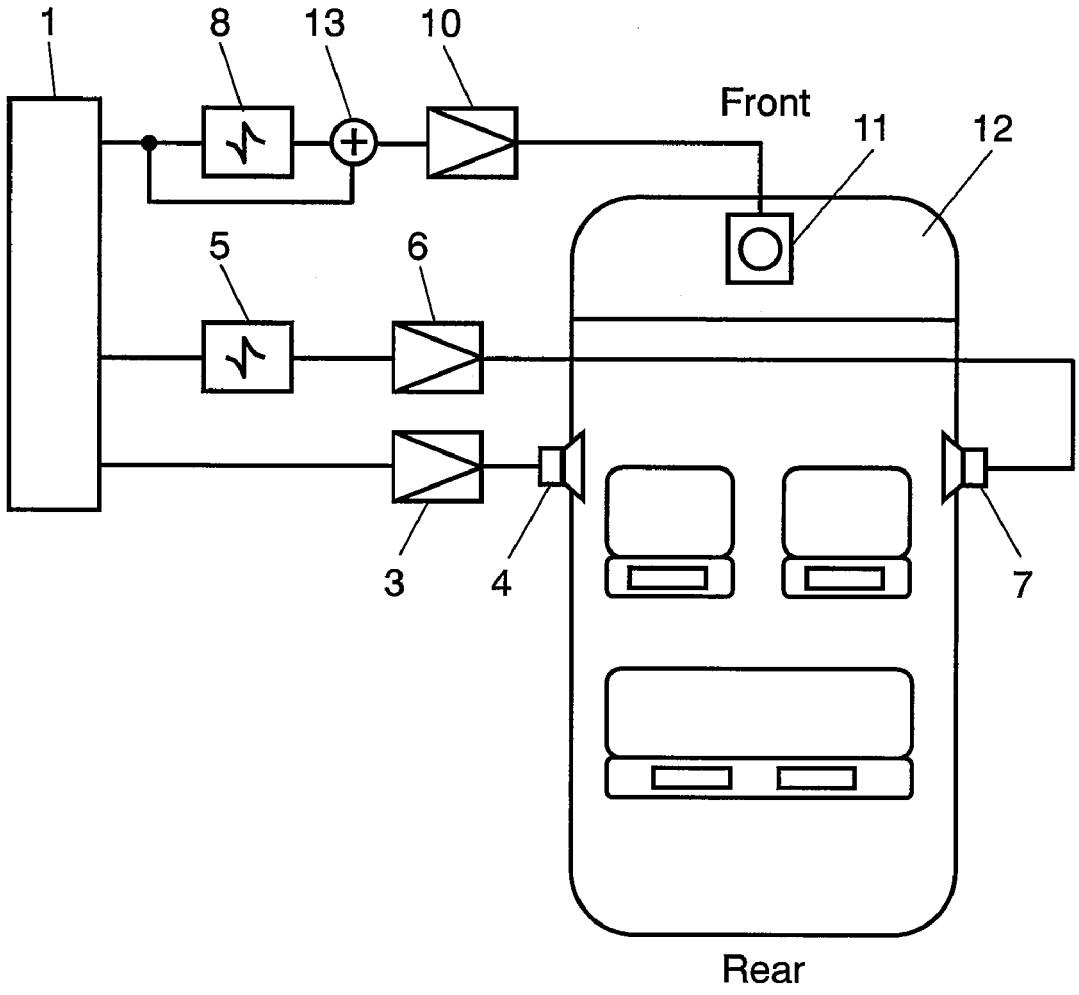
FIG. 1 is a system diagram for use in detailing a sound reproducing apparatus according to a first exemplary embodiment of the present invention.
Figure 5A:
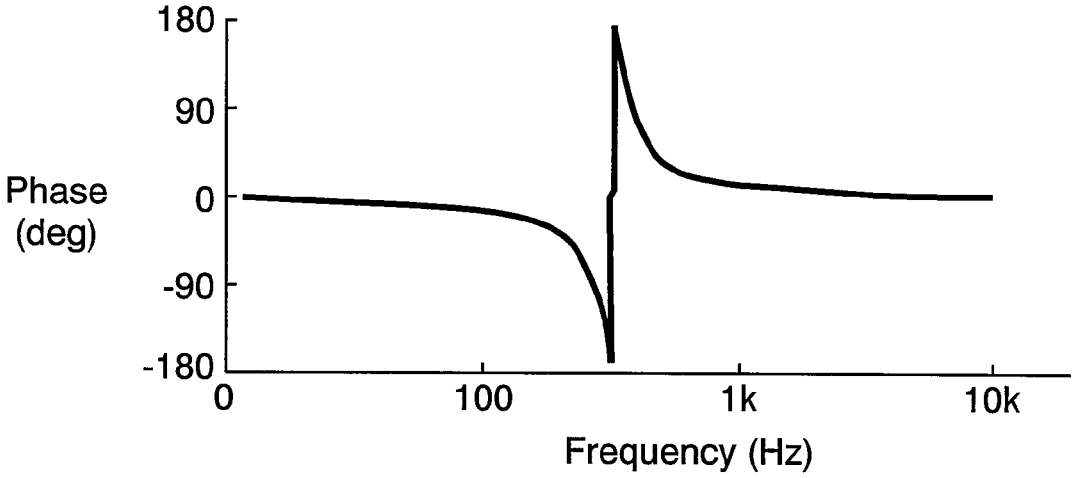
FIG. 5A is a graph showing a phase characteristic of a secondary phase shifter.
Figure 5B:
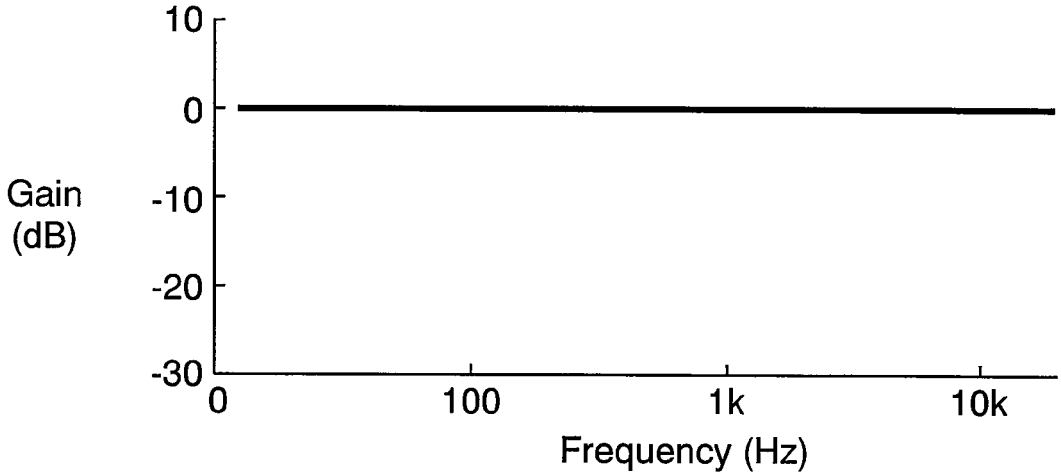
FIG. 5B is a graph showing a gain characteristic of the secondary phase shifter.
Figure 6:
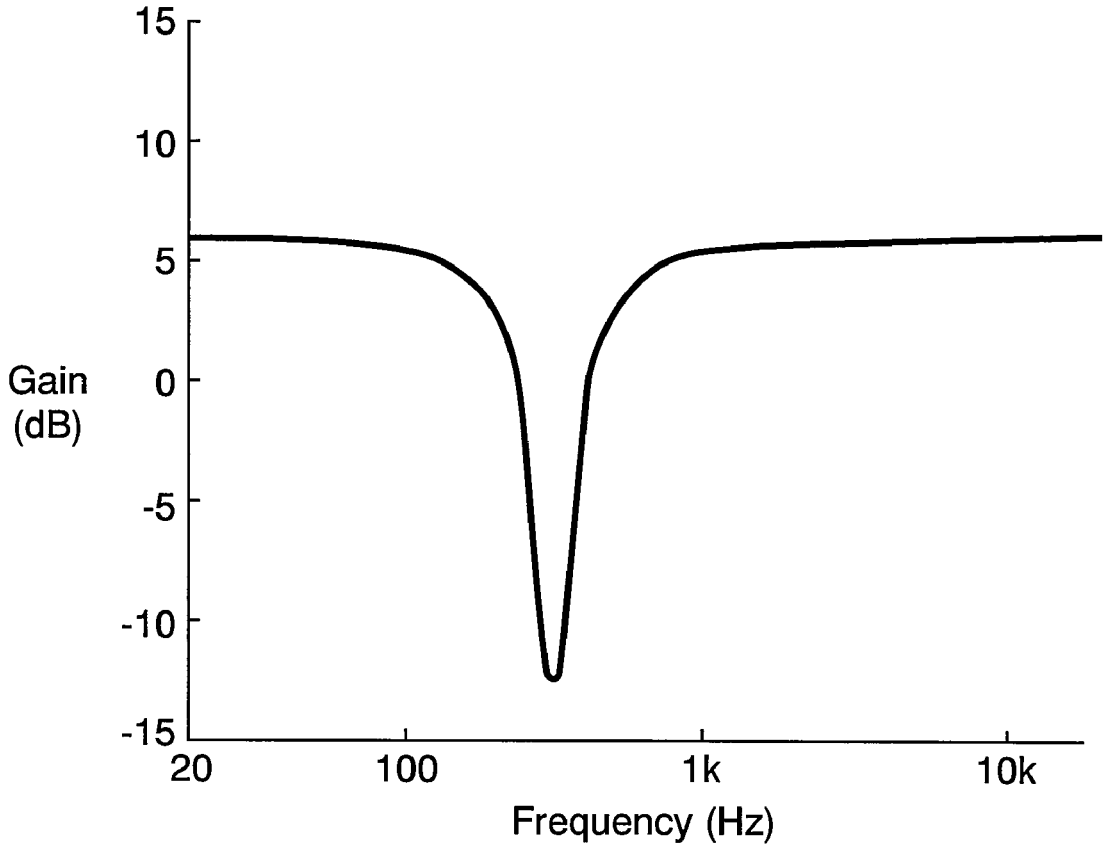
FIG. 6 is a graph showing a gain characteristic of an output obtained by adding an output signal of a second phase shifter and a music signal.

FIG. 1 is a system diagram for use in detailing a sound reproducing apparatus according to the first exemplary embodiment of the present invention. FIG. 5A is a graph showing a phase characteristic of a secondary phase shifter. FIG. 5B is a graph showing a gain characteristic of the secondary phase shifter. FIG. 6 is a graph showing a gain characteristic of an added output of the secondary phase shifter and a music signal source.

In FIG. 1, the sound reproducing apparatus of this invention comprises music signal source 1, power amplifiers 3, 6 and 10, left speaker 4, right speaker 7, center speaker 11, first phase shifter 5, second phase shifter 8 and adder 13, and the apparatus is mounted inside motor vehicle 12.

First and second phase shifters 5 and 8 used in this first exemplary embodiment represent secondary phase shifters, and they are such filters that have a flat gain, and capable of reversing phases steeply at a center frequency of the phase reversion, as shown in FIGS. 5A and 5B. Also shown in FIG. 6 is an output characteristic of adder 13 that adds outputs of second phase shifter 8 and music signal source 1.

It is difficult with the conventional technique to reduce phase interference between center speaker 111 and phase controlled right and left speakers 104 and 107, although reduction of the phase interference has been possible only between right and left speakers 104 and 107. However, the sound reproducing apparatus according to this invention can cut off an output of only the frequency band that causes the phase interference since the output of center speaker 11 is provided with the gain characteristic as illustrated in FIG. 6. Accordingly, the structure can achieve quite excellent reproduction of music by virtue of eliminating the phase interference between center speaker 11, right and left speakers 4 and 7.

Second Embodiment

Figure 2:
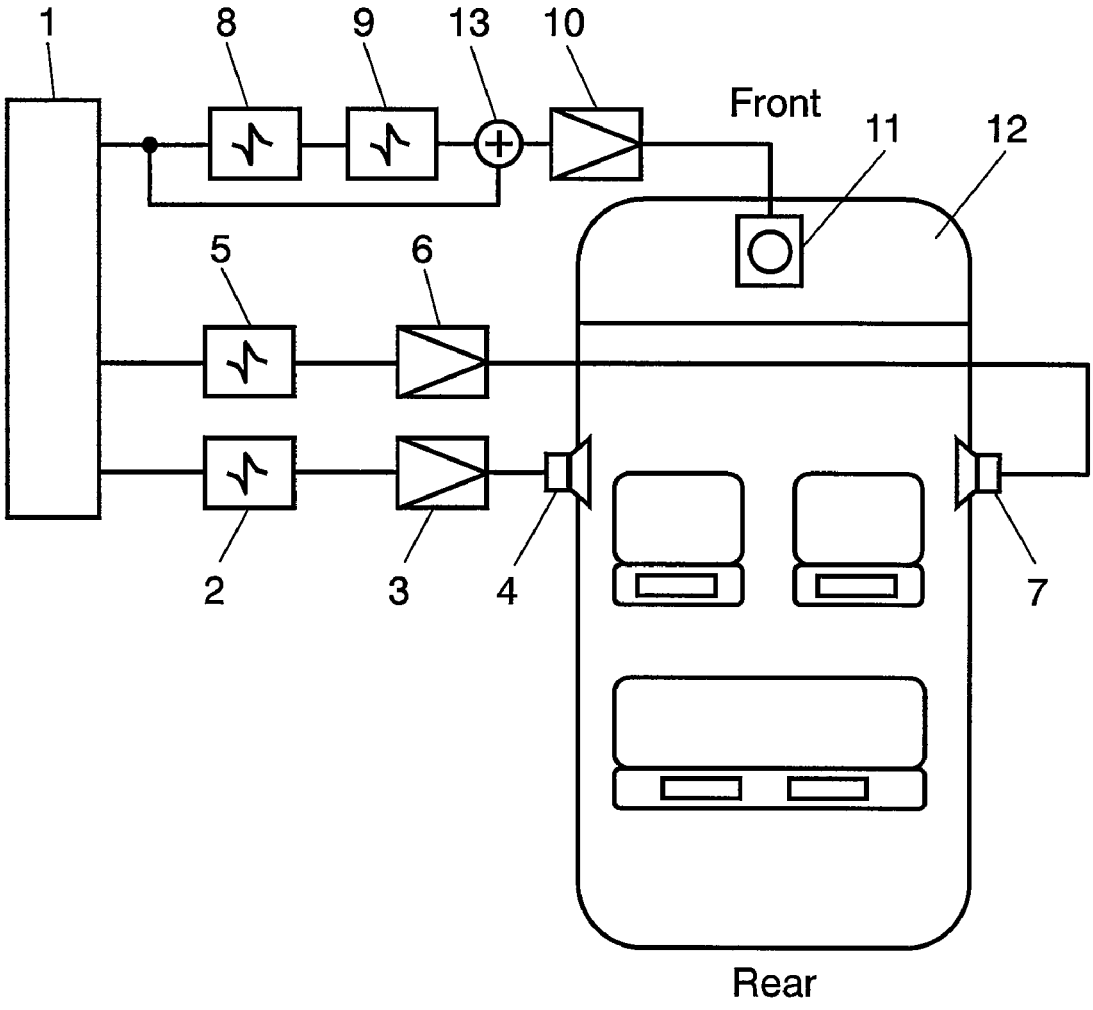
FIG. 2 is a system diagram for use in detailing a sound reproducing apparatus according to a second exemplary embodiment of the present invention.

FIG. 2 is a system diagram for use in detailing a sound reproducing apparatus according to the second exemplary embodiment of the present invention. Description is provided only of different structural components between FIG. 1 and FIG. 2, while omitting details of like components.

Figure 7:
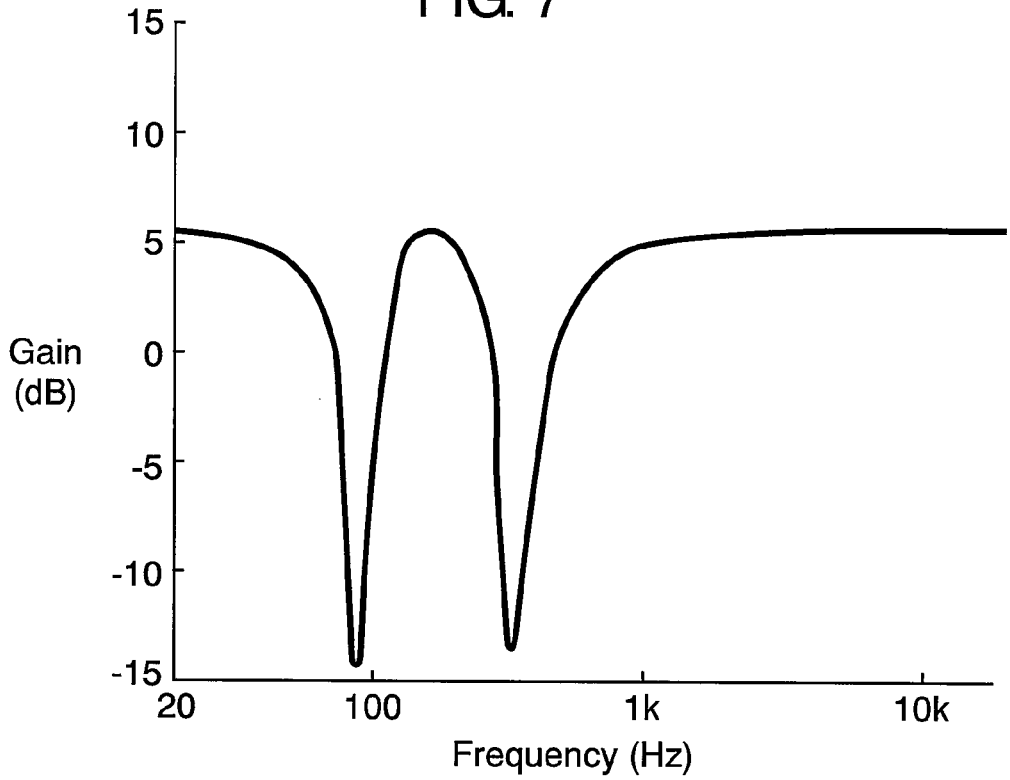
FIG. 7 is a graph showing a gain characteristic of an output obtained by adding an output signal of a second and a fourth phase shifters and the music signal.

Third and fourth phase shifters 2 and 9 used in this second exemplary embodiment serve the secondary phase shifters, which are such filters that have a flat gain, and is capable of reversing phases steeply at a frequency of the phase reversion, as shown in FIGS. 5. Also shown in FIG. 7 is a gain characteristic of adder 13, which adds outputs of second and fourth phase shifters 8 and 9, and music signal source 1.

Use of the structure illustrated above can eliminate phase interference between right and left speakers 4 and 7 and center speaker 11 in response to phase control made by first and third secondary phase shifters 5 and 2, thereby performing quite excellent reproduction of music.

Third Embodiment

Figure 3:
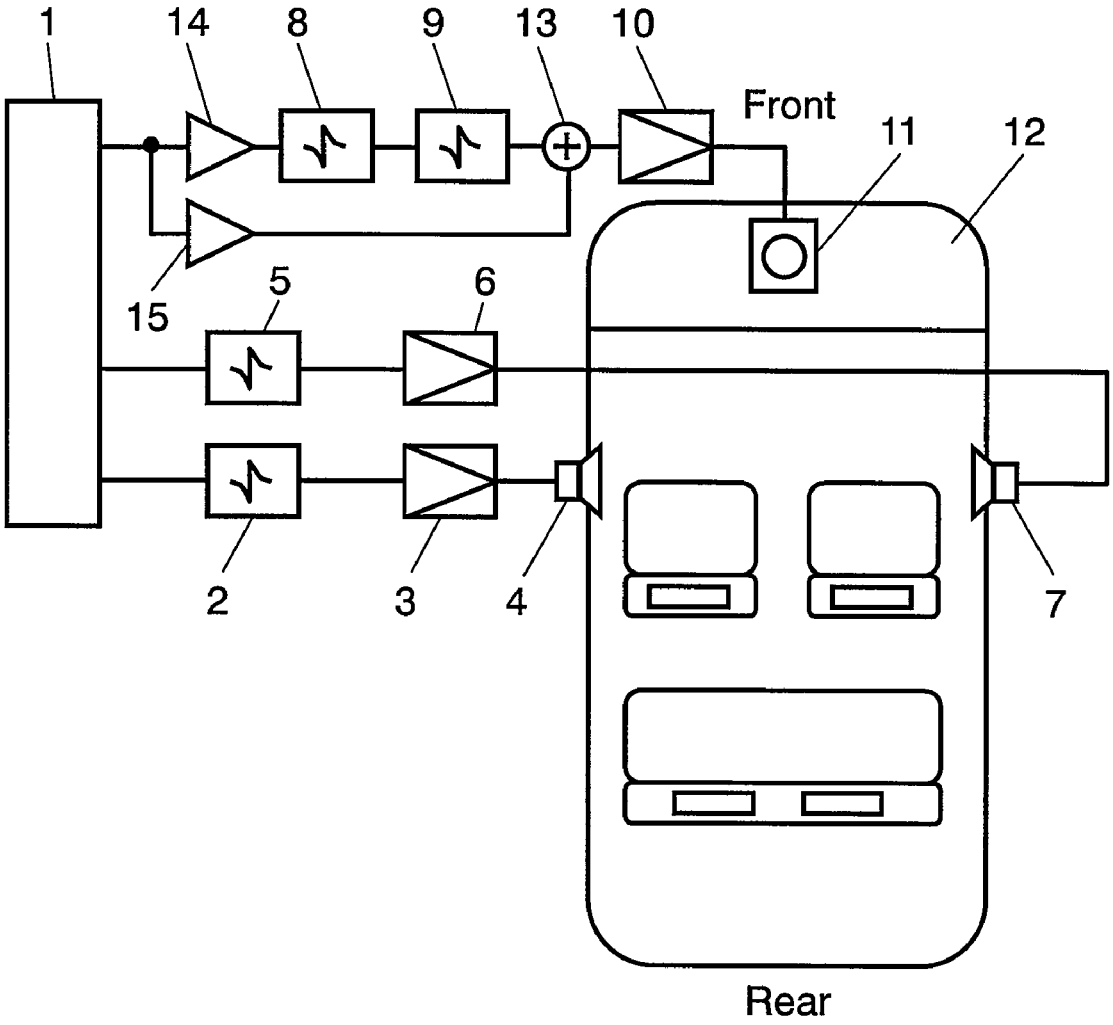
FIG. 3 is a system diagram for use in detailing a sound reproducing apparatus according to a third exemplary embodiment of the present invention.
Figure 8:
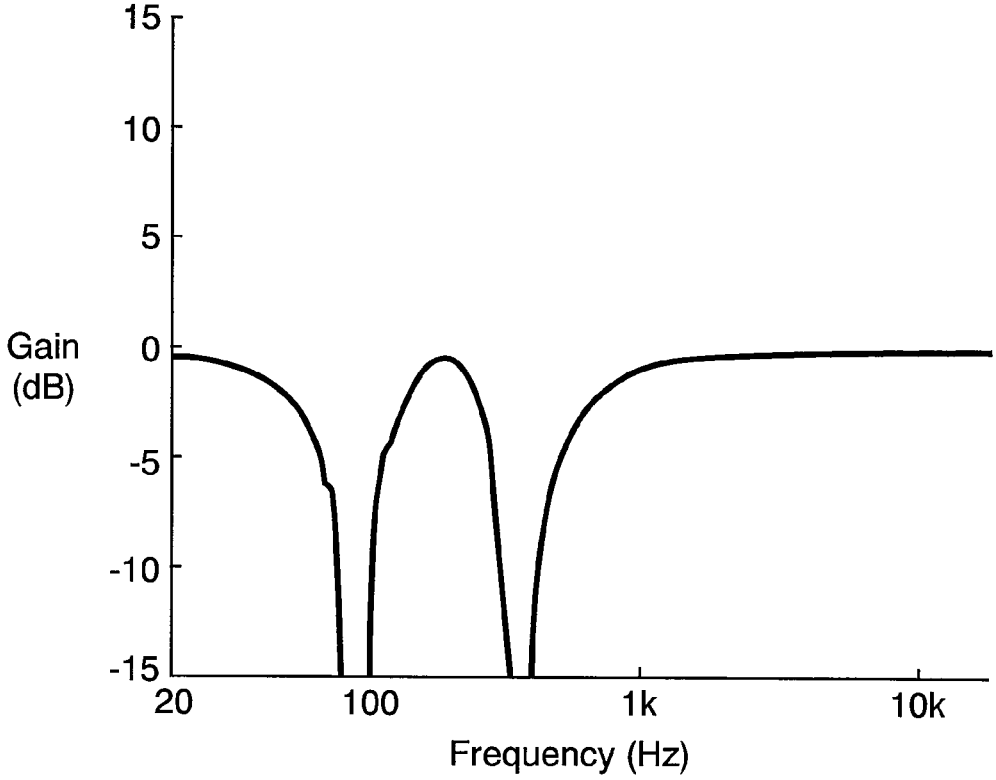
FIG. 8 is a graph showing a gain characteristic of a center speaker obtained by changing a gain of a gain control stage.

FIG. 3 is a system diagram for use in detailing a sound reproducing apparatus according to the third exemplary embodiment of the present invention. FIG. 8 is a graph showing a gain characteristic of a center speaker obtained by changing a gain of a gain control stage.

Description is provided only of different structural components between FIG. 2 and FIG. 3, while omitting details of like components.

The gain characteristic shown in FIG. 8 is obtained with both first gain control stage 14 and second gain control stage 15 set to −6 dB. The input gain and output gain can be made equal especially when they are set up in the above manner.

Use of the structure illustrated above can achieve quite excellent reproduction of music since it enables fine adjustment of the output of center speaker 11 by setting gains of the first and second gain control stages 14 and 15.

Fourth Embodiment

Figure 4:
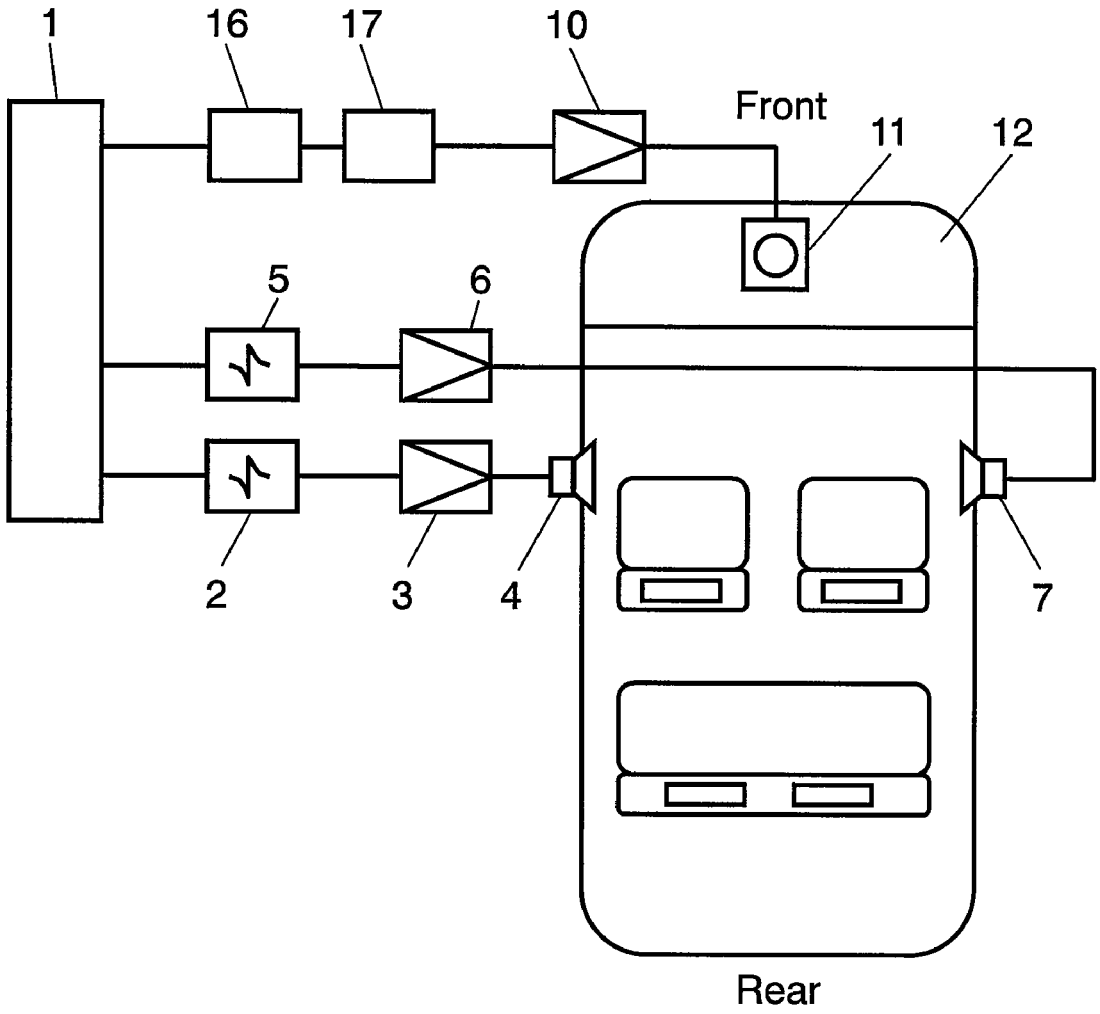
FIG. 4 is a system diagram for use in detailing a sound reproducing apparatus according to a fourth exemplary embodiment of the present invention.

FIG. 4 is a system diagram for use in detailing a sound reproducing apparatus according to the fourth exemplary embodiment of the present invention.

Figure 9:
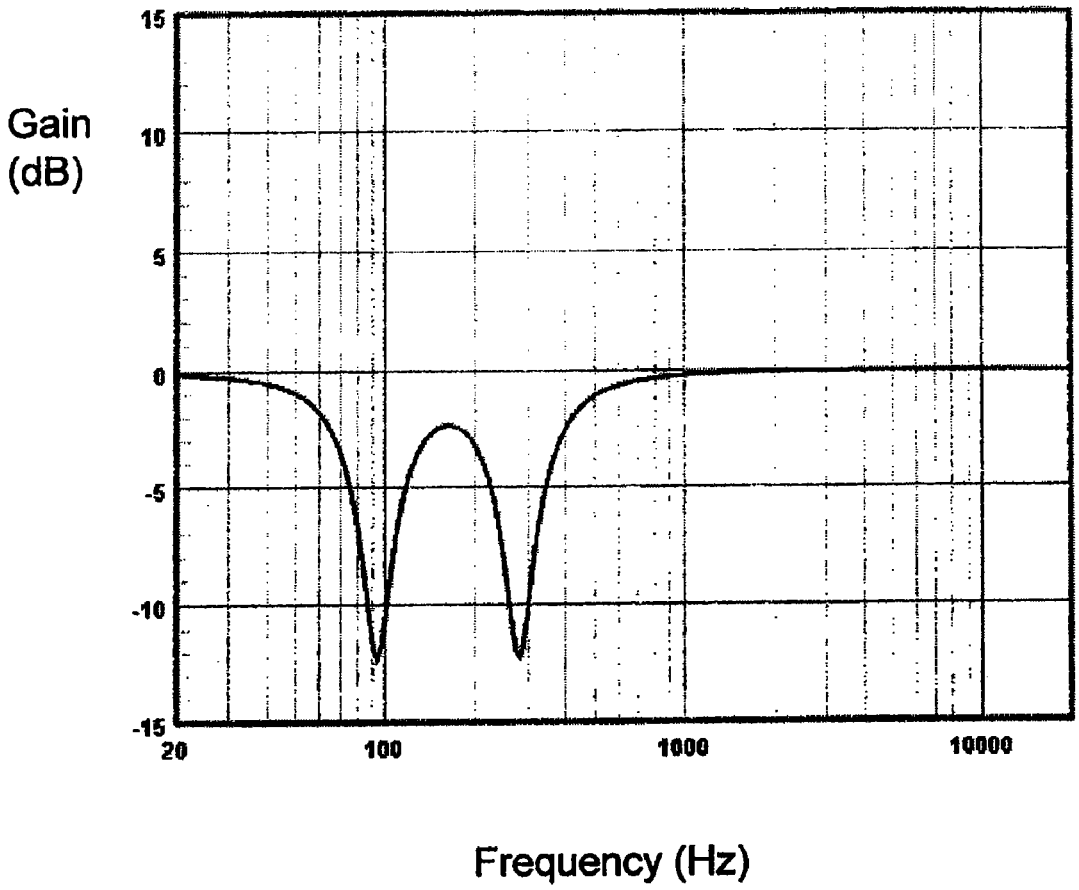
FIG. 9 is a graph showing a gain characteristic of two notch filters.
Figure 10:
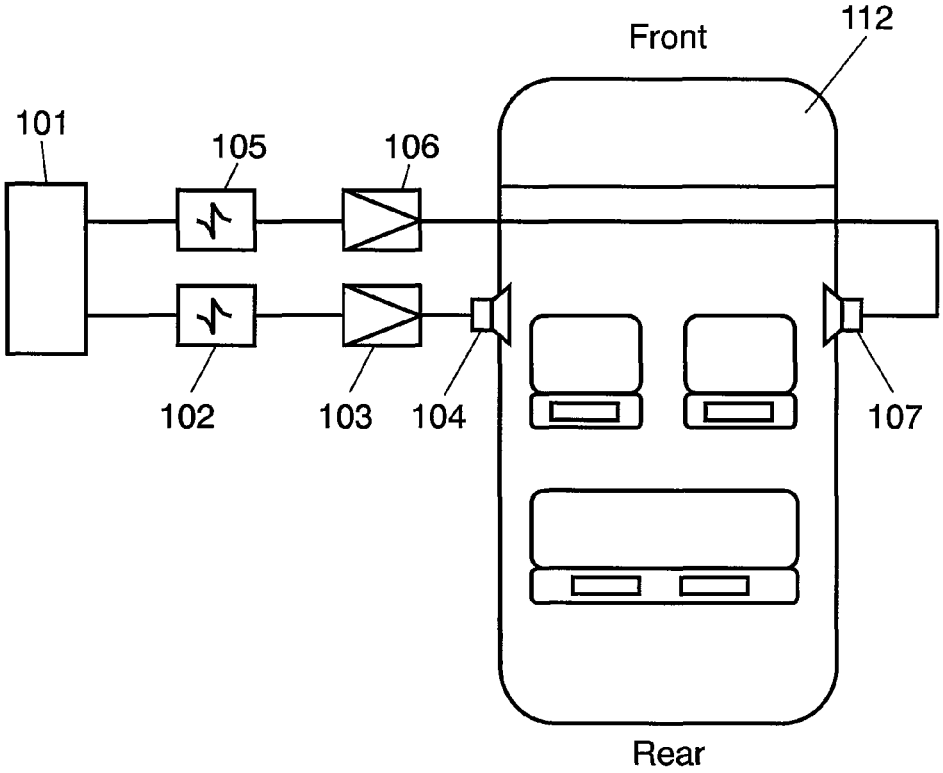
FIG. 10 PRIOR ART
FIG. 10 is a system diagram for use in detailing a conventional sound reproducing apparatus.
Figure 11:
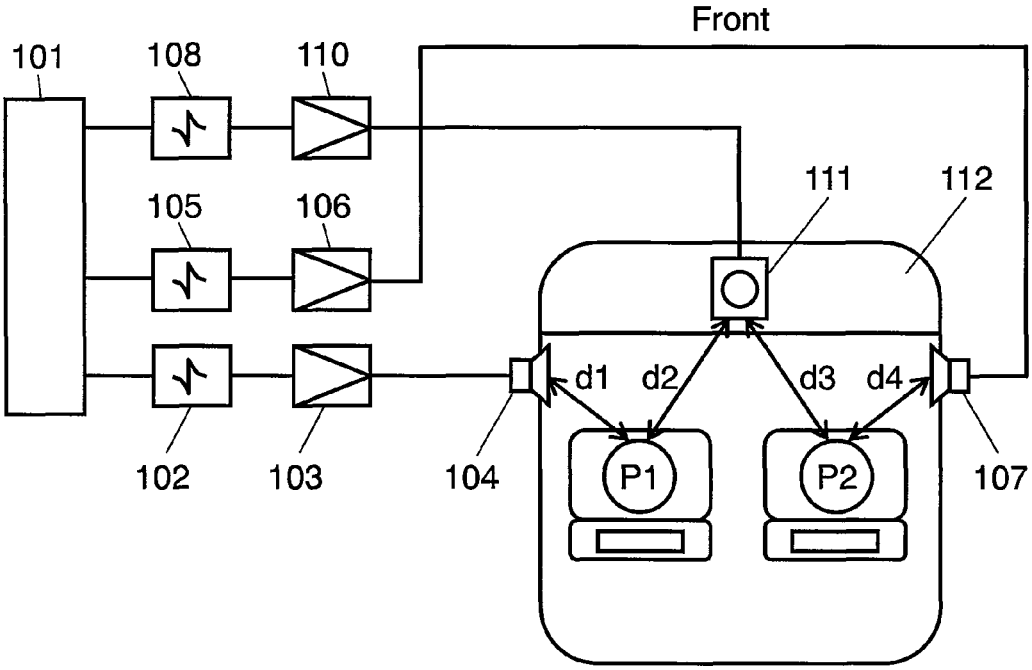
FIG. 11 PRIOR ART
FIG. 11 is a system diagram for use in detailing a drawback of the conventional art.

Description is provided only of different structural components between FIG. 2 and FIG. 4, while omitting details of like components. In the fourth exemplary embodiment of this invention, the sound reproducing apparatus is provided with first notch filter 16 and second notch filter 17. FIG. 9 is a graph of a gain characteristic of notch filters in combination with using notch filters 16 and 17.

Use of the structure illustrated here can eliminate phase interference of center speaker 11 in response to phase control made by first and third secondary phase shifters 5 and 2, thereby performing quite excellent reproduction of music.

In the first through the fourth exemplary embodiments, each individual structure may be comprised of an analog circuit. Or, similar control can be achieved by means of digital signal processing with a microcomputer, a digital signal processor (DSP), and the like, or even with a combination of both analog and digital signal processing.

What have been illustrated in the first through the fourth exemplary embodiments are examples of a typical speaker layout using the right and the left speakers, in combination with the center speaker. However, the present invention is not restrictive only to the center speaker, but is also applicable to a sub-woofer and the like speakers to achieve the like advantage.

Since the sound reproducing apparatus of the present invention has the advantageous effect of reproducing extremely excellent musical sound by eliminating phase interferences between the center speaker and the right and left speakers, it is useful for applications such as a sound reproducing apparatus comprising a multi-channel replay system to be mounted inside a motor vehicle.

What is claimed is:

1. A sound reproducing apparatus comprising:

a music signal source;

at least three channels of power amplifiers for amplifying an output signal of the music signal source; and at least three speakers for reproducing music by outputs of the power amplifiers, wherein at least one channel of the power amplifiers includes at least one secondary phase shifter prior to the respective power amplifier, and at least one remaining channel has at least one other secondary phase shifter and an adder prior to the respective power amplifier, the adder providing an output by adding the output signal of the music signal source and an output signal of the at least one other secondary phase shifter.

2. A sound reproducing apparatus comprising:

a music signal source;

at least three channels of power amplifiers for amplifying an output signal of the music signal source; and at least three speakers for reproducing music from the music signal source by outputs of the power amplifiers, wherein at least two channels of the power amplifiers each comprises at least one secondary phase shifter prior to the respective power amplifier, and at least one remaining channel has at least one other secondary phase shifter and an adder prior to the respective power amplifier, the adder providing an output by adding the output signal of the music signal source and an output signal of the at least one other secondary phase shifter.

3. The sound reproducing apparatus of claim 1 further comprising a gain control stage prior to the at least one other secondary phase shifter and the adder of the at least one remaining channel.

4. The sound reproducing apparatus of claim 2 further comprising a gain control stage prior to the at least one other secondary phase shifter and the adder of at least one remaining channel.

5. The sound reproducing apparatus of claim 1, wherein the at least one secondary phase shifter prior to the respective power amplifier of the at least one channel and the at least one other secondary phase shifter prior to the adder of the at least one remaining channel have a common center frequency of phase reversion.

6. The sound reproducing apparatus of claim 2, wherein each of the at least one secondary phase shifter of the at least two channels of the respective power amplifiers has a different center frequency of phase reversion, and the at least one remaining channel includes at least two other secondary phase shifters, each of the at least two other secondary phase shifters has a different center frequency of phase reversion.

* * * * *